United States Patent [19]

Jacob

[11] 4,367,516

[45] Jan. 4, 1983

[54] MARKSMANSHIP TRAINING DEVICE AND METHOD

[76] Inventor: Lionel C. Jacob, 3805 Warren Ct., Mobile, Ala. 36608

[21] Appl. No.: 203,326

[22] Filed: Nov. 3, 1980

[51] Int. Cl.[3] ..... F41G 1/34

[52] U.S. Cl. ..... 362/111; 362/112; 362/208; 42/1 A; 273/310; 434/21

[58] Field of Search ..... 362/110, 111, 112, 113, 362/114, 208; 42/1 A; 273/310–312; 434/21, 22

[56] References Cited

U.S. PATENT DOCUMENTS

| | | | |
|---|---|---|---|
| 2,657,303 | 10/1953 | Dickens | 362/110 X |
| 3,376,039 | 4/1968 | Fenton | 273/312 X |
| 3,471,945 | 10/1969 | Fleury | 362/110 X |
| 4,048,489 | 9/1977 | Giannetti | 434/21 X |
| 4,102,059 | 7/1978 | Kimble et al. | 273/310 X |
| 4,223,376 | 9/1980 | Ikeda | 273/311 X |

*Primary Examiner*—Peter A. Nelson

*Attorney, Agent, or Firm*—Lockwood, Dewey, Alex & Cummings

[57] ABSTRACT

A conventional firearm having a barrel and a removable marksmanship training device which permits target practice without requiring live ammunition. In a preferred embodiment, the device includes a radiant energy emitting (e.g. strobe light) replacement unit for a cartridge cylinder of a revolver and an elongated lens tube adapted to be received within the barrel. The lens tube is structured for locking registry with the cylinder such that the radiant energy output from the cylinder replacement unit is transmittable through the lens tube as a narrow beam. The lens tube is also equipped with dual set screws which permit selective vertical and horizontal adjustment of the beam.

19 Claims, 12 Drawing Figures

STROBE LAMP FIRING CIRCUIT

FIG. 4
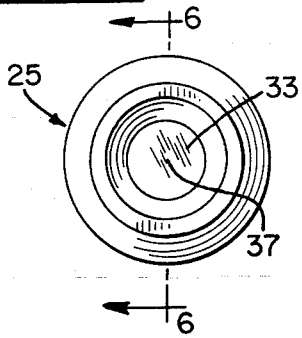
FIG. 5
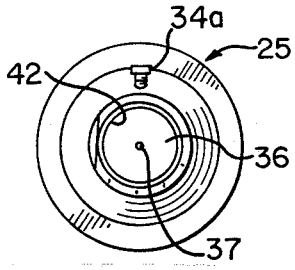
FIG. 7
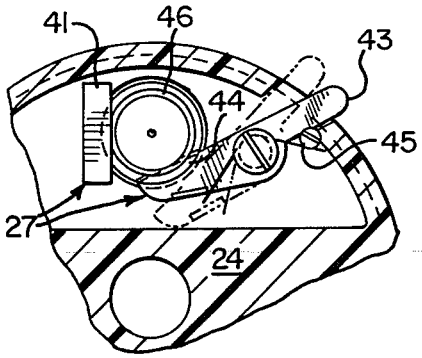
FIG. 6
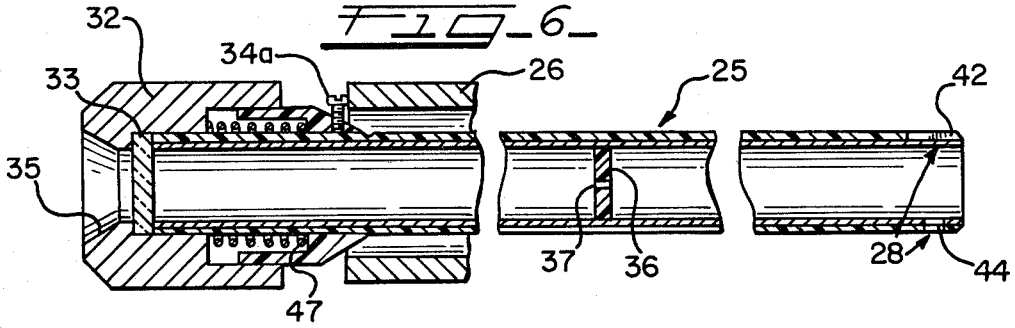
FIG. 9
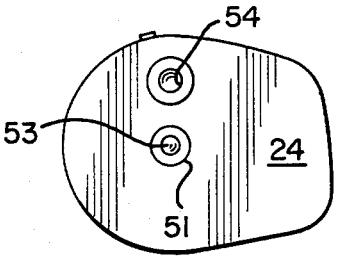
FIG. 10
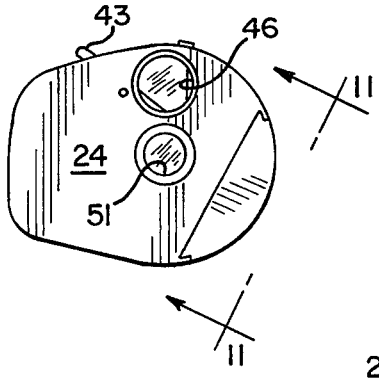
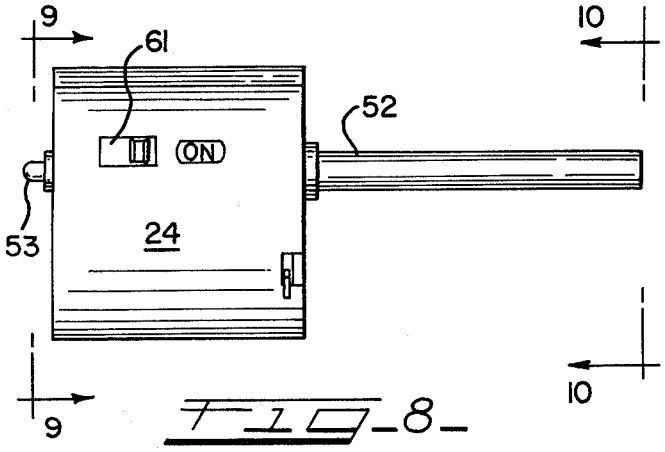
FIG. 8
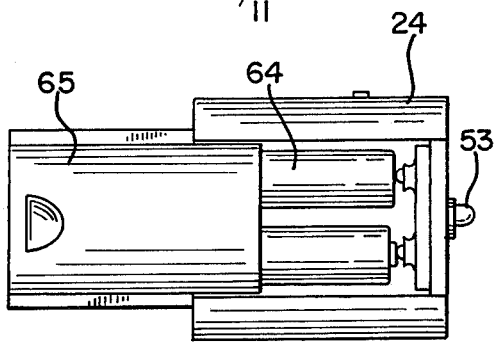
FIG. 11

MARKSMANSHIP TRAINING DEVICE AND METHOD

BACKGROUND AND DESCRIPTION OF THE INVENTION

This invention generally relates to marksmanship training devices and methods and, more particularly, to devices and methods for converting firearms, such as, for example, revolver handguns, into marksmanship training devices which function without requiring live ammunition. In this regard, an important embodiment of the present invention is directed to an improved marksmanship training conversion kit and method which includes a longitudinally adjustable light-emitting lens tube having dual beam adjustment screws that is capable of blind indexing and locking in registry with a radiant energy emitting cylinder, the lens tube and cylinder being sized for use in a variety of firearms.

The concept of using a radiant energy source, such as visible light, instead of live ammunition in order to practice marksmanship or to test firearm sighting structures has long been in use. Heretofore, however, the prior art devices of this type have usually embodied a simulated firearm designed for this purpose only. While some conversion kits of live-ammunition firearms are known, these generally either necessitate modification of the firearm's stock parts or require cumbersome external attachments to the firearm.

The prior art also includes devices for converting a particular model of a firearm into a device for practicing marksmanship and the like; that is, they are of non-universal type. Such devices lack the flexibility that is desirable for conversion kits in general. Being able to market a conversion kit of a generally universal type brings with it significant eonomies for the manufacturer and distributor of the kits, as well as for the ultimate purchaser of the kit who may desire to use the conversion kit for more than one make of firearm.

Previously known firearm conversion kits suffer the numerous drawbacks including being generally cumbersome, lacking in the firmness of assembly needed to give the user the "feel" exhibited by a stock firearm, especially the user's own firearm, thereby reducing significantly the quality of markmanship practice provided when compared with the use of an individual's own unmodified firearm.

In accordance with the present invention, the foregoing problems and disadvantages of markmanship training devices have been overcome through the use of an improved apparatus and method for converting a firearm to a marksmanship training device by replacing the cartridge chamber of the firearm with a cylinder having a radiant energy emitting unit and by inserting a lens tube into the barrel of the firearm which includes dual beam adjustment screws which tube is adapted to be firmly indexed and locked into the cylinder while a chamfered, biased member on the lens tube is placed into secure abutting relationship with the muzzle end of the barrel of the firearm. In use, a beam of radiant energy passes out of this cylinder and into and through the lens tube whereby it is directed toward the particular target at that which it is aimed.

An object of this invention is to provide an improved device and method for converting a firearm into a marksmanship training device.

Another object of the invention is to provide an improved firearm conversion kit suitable for secure and precise installation into a variety of revolver-type firearms without having to alter any of the actual parts of the firearm.

Another object of this invention is an improved marksmanship training device which combines a firearm replacement cylinder with an automatically adjustable elongated barrel-length lens tube.

Another object of this invention is an improved method for converting any one of a variety of revolver-type firearms into a marksmanship training device by merely replacing or adding to the stock parts of the firearm.

Another object of the invention is an improved method for converting any one of a variety of firearms into a marksmanship training device which includes the blind indexing and locking of an elongated lens tube having dual beam adjustment screws with the transmitting cylinder of the conversion kit.

Further objects and advantages of this invention will be apparent from the following description and accompanying drawings in which like reference numerals indicate corresponding parts throughout the several figures and wherein:

FIG. 4 is an end view of the preferred lens tube, taken along the line 4—4 of FIG. 3;

FIG. 5 is an opposite end view of the preferred lens tube, taken along the line 5—5 of FIG. 3;

FIG. 6 is a cross-sectional view of the preferred lens tube, partially cut away, taken along the line 6—6 of FIG. 4;

FIG. 7 is a partial cross-sectional view of the preferred indexing and locking means, taken along the line 7—7 of FIG. 2;

FIG. 8 is an enlarged elevational view of the preferred cylinder;

FIG. 9 is an end elevational view taken along the line 9—9 of FIG. 8;

FIG. 10 is an elevational view of the opposite end of the preferred cylinder, taken along the line 10—10 of FIG. 8;

FIG. 11 is an elevational view taken along the line 11—11 of FIG. 10, showing an open panel of the preferred cylinder.

Figures 1, 2, 3, 12:
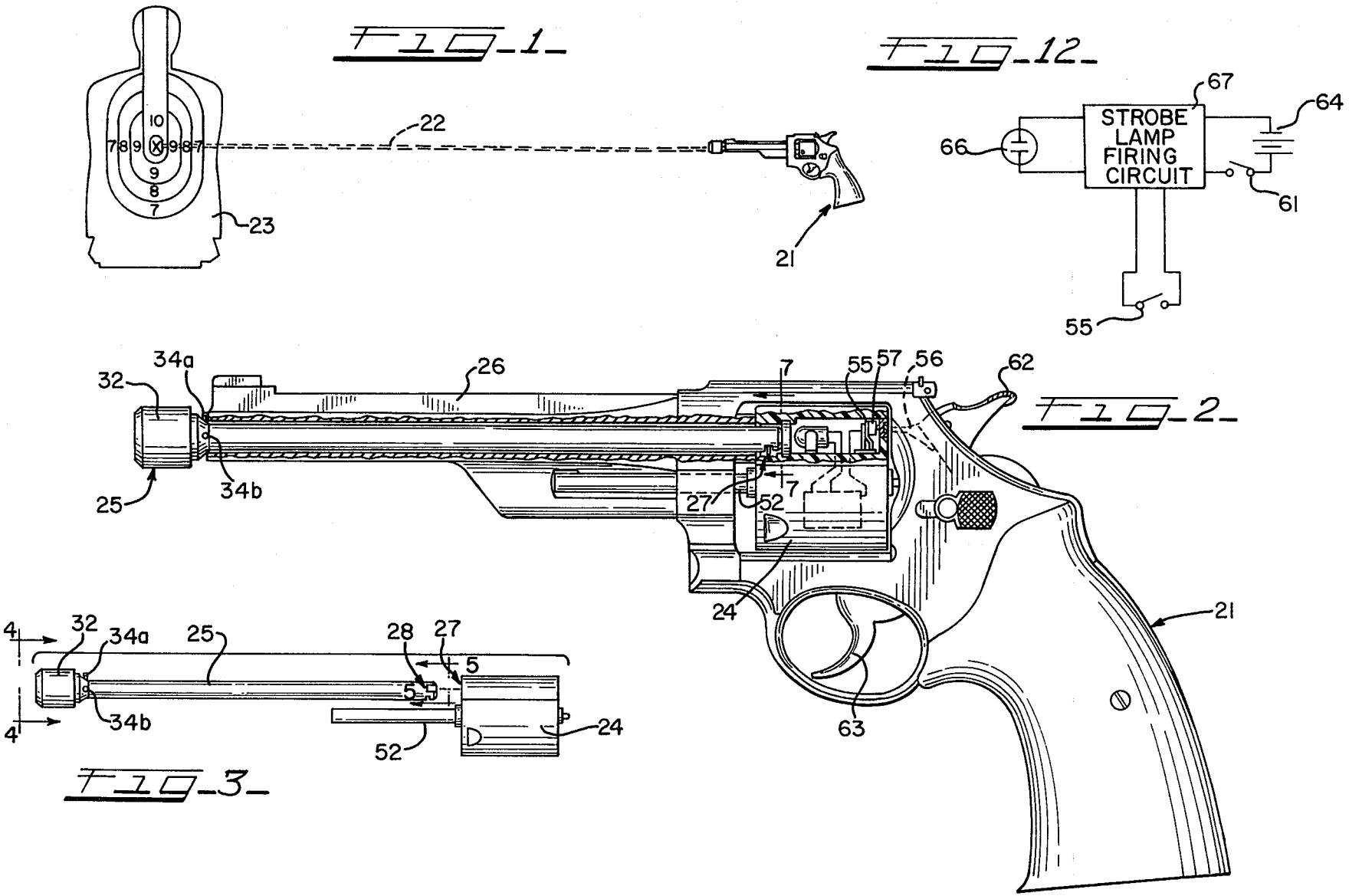
FIG. 1 is an elevation view of a firearm converted in accordance with this invention and of a target suitable for marksmanship practice.
FIG. 2 is an elevation view, partially in section, of a firearm converted in accordance with this invention.
FIG. 3 is an elevation view of the preferred conversion kit.
FIG. 12 is a schematic illustration of a preferred energy supplying circuitry.

Referring to the drawings, FIG. 1 generally illustrates the use of a firearm, generally referred to by reference numeral 21, converted to a marksmanship training device in accordance with the invention. A beam 22 of visible light or other radiant energy is shown directed onto a target 23.

As can be seen more clearly in FIG. 2, the usual revolvable cartridge chamber (not shown) of a conventional firearm 21 has been replaced with a cylinder 24. Also, an elongated lens tube, generally referred to by reference numeral 25, has been inserted into the bore of the barrel 26, the external diameter of the lens tube 25 being less than the internal diameter of barrel 26 of the intended firearm to be used therewith. The lens tube 25 and the cylinder 24 are in engagement by the complementary relationship between an indexing and locking means, generally referred to by reference numeral 27, of cylinder 24 and a registry means, generally referred to by reference numeral 28, near the breach end of lens tube 25. FIG. 3 generally shows cylinder 24 and lens tube 25 in alignment for indexing and locking, both being shown apart from firearm 21.

Lens tube 25 includes a chamfered, biased member 31 structured for a universal type of application to provide abutting engagement with the muzzle end of barrel 26 which may be of any length such that the bias thereof allows for said abutting engagement. That is, the chamfered member 31 has an adequate amount of bias such that the lens tube 25 insertable into the bore of barrel 26 has an adjustable length in order to accommodate differences in barrel lengths that are known to exist among different models and brands of firearms. Likewise, the biasing action of member 31 against the muzzle end of barrel 26 preferably transmits a pulling force to registry means 28 when in engagement with indexing and locking means 27 to thereby form a secure fastening relationship between cylinder 24 and lens tube 25.

Lens tube 25 also includes an external component 32 in which is housed a lens 33, shown in FIG. 4. The external component 32 can be press-fitted or otherwise secured to lens tube 25 by any suitable means compatible with the biasing structure of member 31. Dual set screws 34*a* and 34*b* are adapted to contact the barrel 26 and respectively provide selective vertical and horizontal adjustment of the positioning of the lens tube 25 within the barrel 26. Compartment 32 also includes an opening 35 to permit the beam of radiant energy passing through lens 33 to exit component 32 for passage to a location such as target 23. Mounted along the length of lens tube 25 is a disc 36 made of a material through which the source of radiant energy cannot generally pass, except that the energy, such as visible light, is allowed to pass through a small-sized aperature or pinhole 37 in disc 36. For example, disc 36 may be made of a non-transparent, non-translucent material so that visible light from cylinder 24 will pass only through pinhole 37 in order to pass a narrow beam of light to lens 33.

The preferred indexing and locking means 27 is shown in greater detail in FIG. 7. Means 27 accomplishes its indexing function by including a ridge member 41 structured for abutting engagement with a flat 42 of the registry means 28 at the breach end of lens tube 25. The locking feature of the preferred indexing and locking means 27 is provided by a pivotable lever 43 generally within cylinder 24 and a corresponding slot 44 of the registry means 28, the slot 44 being within the breach end of the lens tube 25. Preferably, lever 43 is biased, by means of a hair spring 45 or the like, in locking orientation to its locking position, which position is illustrated with solid lines in FIG. 7, while the unlocked position of pivotable lever 43, which is in opposition to said bias, is shown in phamtom outline in FIG. 7. Note that lever 43 is operationally accessible from the outside of cylinder 24.

Ridge member 41 and pivotable lever 43 of the indexing and locking means 27 cooperate with the flat 42 and the slot 44, respectively, of the registry means 28, and preferable also with the biased member 31 of the lens tube 25 in order to achieve the secure engagement of cylinder 24 and tube 25 that is a feature of this invention. Lens tube 25, when inserted into and through the barrel 26, is aligned with a radiant energy emission aperture 46 of cylinder 24 at the general location of the indexing and locking means 27. When the pivotable lever 43 is in its locking position, lens tube 25 will be stopped from complete insertion into aperture 46. Accordingly, at this time, pivotable lever 43 is moved against its bias to its unlocking position, while at the same time the lens tube 25 is rotated until its flat 42 is aligned with ridge member 41 of the indexing and locking means 27. Then, the pivotable lever 43 is allowed to move in response to its bias into slot 44 of the registry means 28 to assume its locking position.

It will be appreciated that while indexing and locking means 27 and the registry means 28 as shown in the drawings and discussed in detail herein represent a preferred embodiment, other indexing and locking arrangements may be substituted therefor which produce a secure and positive attachment of cylinder 24 and lens tube 25 such that they will not be jarred loose while in use and so that the breach end of lens tube 25 is precisely and firmly aligned with the radiant energy emission aperture 46 of cylinder 24. For example, an alternate embodiment (not shown) of means 27 and means 28 is contemplated which includes but a single lever, slot, and flat combination that would serve to index cylinder 24 and lens tube 25 with respect to each other while simultaneously bringing about the required locking function.

The preferred chamfered, biased member 31 of the lens tube 25 is detailed in FIG. 6. Member 31 includes a biasing means 47, such as the spring shown and set screws 34*a* and 34*b* which provide selective vertical and horizontal adjustments for the lens tube 25, thereby enabling "elevational" and "windage" type adjustments to the bullet-simulating beam emitted from the lens tube 25. As best shown FIG. 6, component 32 is in slidable engagement with a channel 48 in order to permit movement of member 31 against the bias of biasing means 47 so as to, in effect, provide the lens tube 25 with an automatic length adjustment that also simultaneously securely and positively sets the centering engagement between the barrel 26 and the chamfered member 31. The centering engagement is generally provided by the chamfer of biased chamfered member 31 being generally concentric with the longitudinal axis of the lens tube 25 and the bore of barrel 26.

As can be seen in FIGS. 9 and 10, the cylinder 24 includes a longitudinal bore 51 which is sized and positioned for receiving an ejector rod 52. Rod 52 may be either the stock ejector rod of the firearm 21, or it may be one of similar configuration which is especially suitable for mounting cylinder 24 within the frame of the firearm 21 but which is otherwise generally of the same structure of the firearm's stock ejector rod. Cylinder 24 also preferably includes a biased centering button 53 which is substantially identical in structure with a similar feature of the stock cartridge chamber of the firearm. The combination of ejector rod 52 and centering button 53 allows for ease of insertion and removal of cylinder 24 in replacement of the stock cartridge chamber of the firearm 21 in a manner well known to those skilled in the art. However, the replacement cylinder 24 is structured to intentionally preclude its rotation about ejector rod 52. Generally, this is accomplished by either or both providing a smooth surface at the location of cylinder 24 that is in approximate communication with the customary cartridge chamber indexing and ratcheting means of firearm 21 so as to nullify its operation to rotate the cylinder 24 so that it will be non-rotatable by virtue of the cylinder 24 being generally engaged with the frame of the firearm 21.

The cylinder 24 includes an orifice 54 that provides a passageway to an activator switch 55 within the cylinder 24, which switch 55 is closed or otherwise activated in response to being contacted and jarred by a firing pin 56 of the firearm 21. It is preferred to have the activator switch 55 include on its outside surface a cushion 57 which both protects the firing pin 56 and also minimizes shock to the cylinder 24 itself. The cushion 57 may be made of a urethane or other similar material suitable for softening impacts.

An on-off switch 61, which is shown in FIG. 8, allows for energization of the circuitry within cylinder 24 upon depression of the activator switch 55 through the action of the firing pin 56 which is, of course, responsive to the forward movement of hammer 62 in response to the pulling of trigger 63. Each of the firing pin 56, hammer 62, and trigger 63 is the unmodified part of the stock firearm.

Power may be supplied to the circuitry by means of dry cell batteries 64 as depicted in FIG. 11, accessible through a member such as a slidable door 65. Also suitable is the use of rechargeable batteries and/or a 6-volt adapter connected to an outside power supply. The exact nature of the power source is not critical to this invention. When the radiant energy source is provided by a strobe light unit in accordance with the preferred embodiment of this invention, any one of the several circuits known to the art, such as those used in electronic flash devices, may be used. An example of specific circuitry that may be utilized in this regard is illustrated schematically in FIG. 12. Each of the activator switch 55, the on-off switch 61, the power source 64, and the strobe lamp 66 are associated with a strobe lamp firing circuit 67 of one of the several known types which usually include a capacitor, an oscillator and a transformer.

By practicing the method of this invention, a stock firearm manufactured by any one of several commercial gun makers is readily converted from a firearm that discharges live ammunition to one that emits a beam of radiant energy to thereby provide a means for marksmanship training without having to modify any of the firearm's stock parts.

The method includes removing the cartridge chamber of the firearm and replacing it with a cylinder member for providing a radiant energy source followed by inserting an elongated lens tube member into the barrel of the firearm at a location from which the radiant energy source is emitted, and preferable until in locking registry with a radiant energy aperture outlet from the cylinder member and until a firm abutting relationship is established between the lens tube member and the muzzle end of the firearm's barrel.

More particularly, the stock cartridge chamber of the firearm is removed by laterally sliding the stock ejector rod out of engagement with the cartridge chamber, which permits the cartridge chamber to be removed from the frame of the firearm in association with depressing a biased centering button on the cartridge chamber. Then, the cylinder member having the radiant energy source is inserted within the same location in the frame by depressing its biased centering button and by sliding the ejector rod into a longitudinal bore in the cylinder member. By this step, the radiant energy aperature outlet is in general alignment with the breach end of the barrel of the firearm.

Next, an elongated lens tube member is passed through the barrel, resulting in its breach end being in general alignment with the aperture outlet for the energy source. The method proceeds by accomplishing a blind indexing and locking of the breach end of the lens tube member into aligning registry with the radiant energy aperture outlet. It is preferred to have, simultaneously with this indexing and locking step, a centering and contacting step which automatically centers and stabilizes the muzzle end of the lens tube member by means of a biased chamfered surface on the lens tube member while also automatically adjusting the effective length of the lens tube member to accommodate the length of the particular firearm's barrel. These steps result in a firm, positive alignment of the radiant energy aperture outlet with the centered lens tube member and with the lens itself such that when the energy source is activated, the energy, for example visible light, will pass to the centered lens tube member and through the lens thereof for eventual contact with the object at which the firearm is aimed.

The energy source activating steps are initiated by discharging the firearm in the manner for which it was designed. That is, the operator squeezes the trigger which results in a rapid, forward projection of the hammer into contact with the firing pin. In the present method, an activator switch member of the cylinder member is aligned, upon insertion of the cylinder member into the frame, with the firing pin. The activator switch means is adapted for cushioning the impact of the firing pin to thereby avoid damage to the pin itself and to the activator switch member.

The cylinder member is adapted so that it is nonrevolvable; that is, it will not be ratcheted by conventional ratcheting means present in stock firearms for the purpose of revolving the cartridge chamber around the ejector rod to serially align each successive cartridge in the cartridge chamber with the firing pin after the preceding cartridge has been discharged. In other words, in the present method, any rotation of the cylinder member is intentionally precluded so as to maintain the required alignment of the firing pin with the cushioned activator switch member and at the same time maintain the required alignment of the aperture outlet for the energy source with the breach end of the lens tube member.

Modifications and variations of the described embodiments of this invention will be apparent to those skilled in the art, and it is thus contemplated that such changes may be made without departing from the spirit of the invention or the scope of the appended claims.

I claim:

1. An apparatus for converting a firearm having a barrel and a removable cartridge chamber to a marksmanship training device, comprising: a lens tube structured and sized for secure insertion into a barrel of a firearm; a cylinder structured and sized for a general replacement fit for a cartridge chamber of the firearm; said lens tube having a lens, a registry means at its breach end, and a biased chamfered member at its muzzle end, said chamfered member including beam travel adjustment means for independently adjusting the vertical and horizontal positioning of said chamfered member with respect to the muzzle end of said barrel; an indexing and locking means on said cylinder complementary with the registry means of the lens tube; a radiant energy source for projecting radiant energy into and through the lens tube; and, a switch means for activating the energy source in response to the firing mechanism of the firearm.

2. The apparatus of claim 1 wherein said biased chamfered member and said lens tube member are sized to have the biased chamfered member exert a force against the muzzle end of the barrel which in turn transmits a pulling force to the registry means when in engagement with the indexing and locking means.

3. The apparatus of claim 1 wherein the outer diameter of the lens tube which is between the biased chamfered member and the breach end of the lens tube is less than the internal diameter of the barrel of the firearm.

4. The apparatus of claim 1 wherein said lens tube includes an external compartment at its muzzle end, said external compartment housing said lens.

5. The apparatus of claim 1 further comprising a disc mounted within said lens tube, said disc having a pinhole for passing a narrow beam of radiant energy to the lens in said lens tube.

6. The apparatus of claim 1 wherein said indexing and locking means includes a ridge member structured for abutting engagement with a flat of said registry means and also includes a lever structured for locking engagement with a slot of the registry means.

7. The apparatus of claim 1 wherein said indexing and locking means includes a lever that is biased in locking orientation with respect to said registry means of the lens tube.

8. The apparatus of claim 1 further comprising an aperture of said cylinder which is in alignment with the breach end of the lens tube, said aperture being at the general location of the indexing and locking means and being the location at which radiant energy is emitted from the cylinder.

9. The apparatus of claim 1 further comprising an external compartment at the muzzle end of said lens tube and a channel in said biased chamfered member, said external compartment including a set screw mounted within and through the external compartment and into slidable engagement with said channel.

10. The apparatus of claim 1 wherein said biased chamfered member is spring-biased.

11. The apparatus of claim 1 wherein the chamfer of said biased chamfered member is generally concentric with the longitudinal axis of said lens tube and said beam travel adjustment means comprises a vertically and a horizontally oriented set screw.

12. The apparatus of claim 1 wherein said cylinder includes a longitudinal bore sized and positioned for receiving an ejector rod, said cylinder being further structured to preclude any rotation thereof about said ejector rod.

13. The apparatus of claim 1 wherein said cylinder includes an orifice which, when the cylinder is installed, is in general alignment with a firing pin of the firearm, said cylinder further including an activator switch within the cylinder and behind the orifice, the activator switch being activated in response to said firing pin.

14. The apparatus of claim 13 wherein said activator switch is cushioned.

15. The apparatus of claim 1 wherein said radiant energy source includes an activator switch responsive to a firing pin of the firearm, a power supply, a strobe lamp, and a strobe lamp firing circuit.

16. A method for converting a firearm having a barrel and revolvable cartridge chamber to a marksmanship training device, comprising: removing the revolvable cartridge chamber from the frame of a firearm; replacing the cartridge chamber with a non-revolvable cylinder member having a radiant energy source; inserting an elongated lens tube member provided with vertical and horizontal beam travel adjustment means into the muzzle end of the firearm until the breach end of said tube contacts the cylinder member at a location from which the radiant energy source is emitted; and, blindly indexing and locking the breach end of the lens tube member into said cylinder member.

17. The method of claim 16 further comprising securely contacting the muzzle end of the barrel with a biased, chamfered surface of said lens tube substantially simultaneously with said blind indexing and locking step.

18. The method of claim 16 further comprising automatically aligning a radiant energy source activator switch member of the cylinder member with a stock firing pin member of the firearm, whereby the radiant energy source is activated upon contacting said switch member with said firing pin member upon pulling a trigger of said firearm.

19. The method of claim 16 further comprising activating said radiant energy source by supplying power to a capacitor member for powering a strobe light unit, thereby transmitting a visible light radiant energy source through said lens tube member.

* * * * *